United States Patent [19]

Isakov

[11] Patent Number: 4,550,791

[45] Date of Patent: Nov. 5, 1985

[54] TWO-PRONG ROTARY BIT, ESPECIALLY FOR USE WITH ROOF DRILLS, AND INSERT THEREFOR

[75] Inventor: Edmund Isakov, Latrobe, Pa.

[73] Assignee: Kennametal Inc., Latrobe, Pa.

[21] Appl. No.: 719,027

[22] Filed: Apr. 3, 1985

Related U.S. Application Data

[63] Continuation of Ser. No. 538,765, Oct. 3, 1983, abandoned.

[51] Int. Cl.[4] ..... E21B 10/54

[52] U.S. Cl. ..... 175/410; 175/392

[58] Field of Search ..... 175/410, 329, 331, 334, 175/335, 385, 392, 421, 417, 418

[56] References Cited

U.S. PATENT DOCUMENTS

| | | | |
|---|---|---|---|
| 2,650,071 | 8/1953 | Rassieur | 175/410 |
| 4,373,593 | 2/1983 | Phaal et al. | 175/410 |

FOREIGN PATENT DOCUMENTS

| | | | |
|---|---|---|---|
| 713475 | 8/1931 | France | 175/410 |
| 685967 | 1/1953 | United Kingdom . | |
| 705020 | 3/1954 | United Kingdom . | |
| 736983 | 9/1955 | United Kingdom . | |
| 822029 | 10/1959 | United Kingdom . | |
| 1050116 | 12/1966 | United Kingdom . | |

*Primary Examiner*—Stephen J. Novosad
*Assistant Examiner*—Thuy M. Bui
*Attorney, Agent, or Firm*—Lawrence R. Burns

[57] ABSTRACT

Disclosed according to the present invention is a two-prong rotary drill bit, especially for use with roof drills. The two-prong bit has a supporting body having an axis of rotation. The two-prong bit has a pair of inserts, one insert on each of the prongs. Each of the inserts has a cutting portion facing in the direction of rotation and a mounting portion. When viewed in a direction parallel to the axis of rotation, each of the inserts will have a cross sectional configuration which is generally wedge-shaped. Also disclosed are wedge-shaped inserts especially for use with roof drill bits.

18 Claims, 10 Drawing Figures

Fig. 1
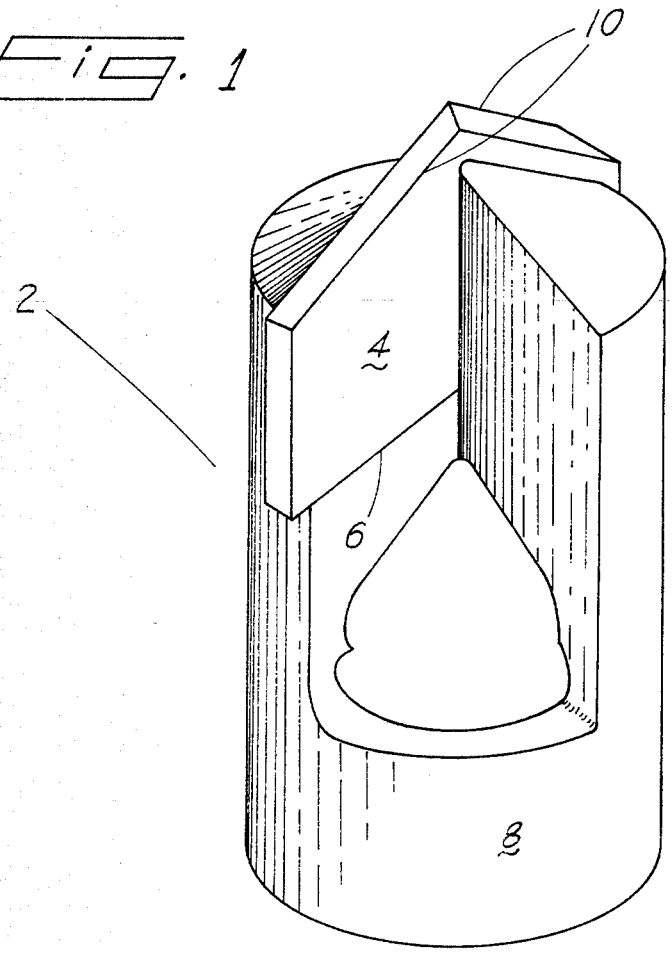
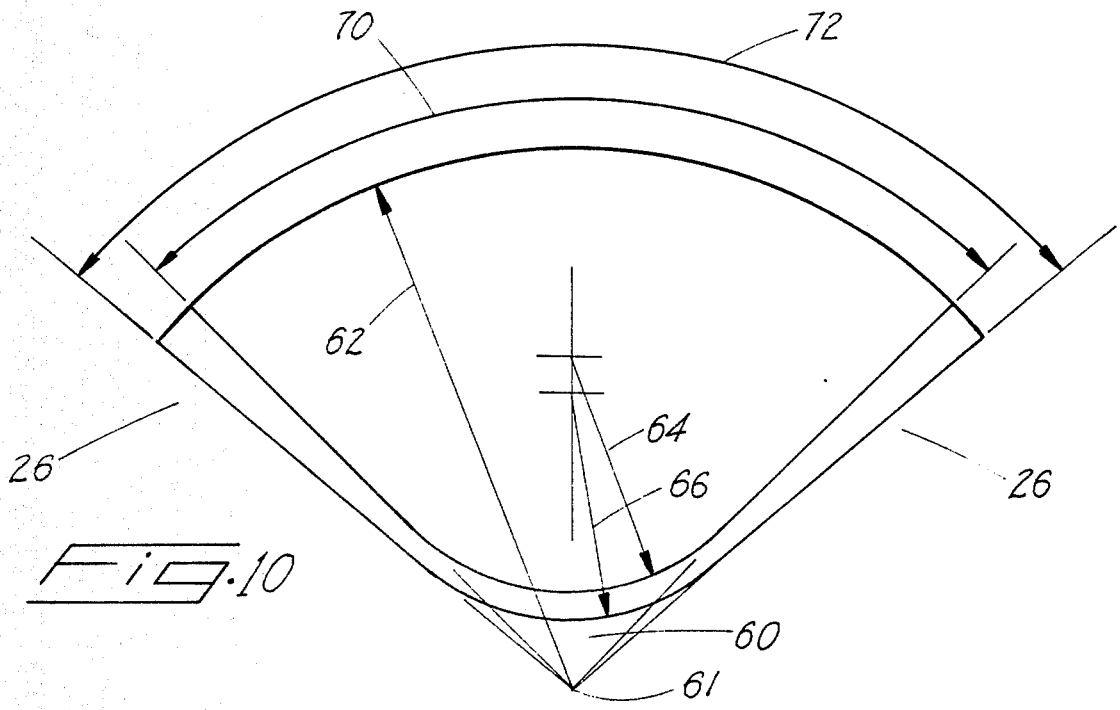
Fig. 10

TWO-PRONG ROTARY BIT, ESPECIALLY FOR USE WITH ROOF DRILLS, AND INSERT THEREFOR

This is a continuation of application Ser. No. 538,765, filed Oct. 3, 1983, now abandoned.

BACKGROUND OF THE INVENTION

The present invention relates to rotary drilling tools and, more particularly, relates to roof drill bits for use in coal mines.

Most particularly, the present invention relates to two-prong, center vacuum roof drill bits.

Roof drills are used for drilling holes in the roofs of underground coal mines. After the hole is drilled, the drill is removed and an anchor is inserted in the hole as an aid in supporting the mine roof. Under certain conditions, a roof drill bit is selected which can be used in conjunction with a vacuum system. When the vacuum system operates through the center of the bit, it is called a center vacuum bit. The purpose of the vacuum system is to collect the fine particles generated during the drilling of the hole. When this center vacuum roof drill bit becomes worn, it must be replaced.

The center vacuum roof drill bit which has been the standard in the coal mining industry for a number of years is illustrated in FIG. 1. This drill bit 2 can be generally described as an insert 4 brazed 6 to a supporting body 8 wherein the insert comprises a flat piece of hard, wear resistant material (usually cemented carbide). The hard insert has a zero degrees rake angle and a continuous cutting edge profile 10 extending diametrically across the roof drill bit.

There are a number of long-standing problems with this prior art roof drill bit. A distinct disadvantage of a continuous cutting edge profile is the lack of cutting speed in the center of rotation, thereby requiring higher thrust at this point to penetrate the rock. The higher thrust required may cause the bit to fail, especially when drilling in hard rock formations.

Another problem with the prior art roof drill bit is the cutting action of the bit. The prior art roof drill bit proceeds through the rock by first primarily crushing the rock, then penetrating into the crushed rock and finally shearing the rock. This type of action requires a high thrust with a concomitant increase in wear of the hard, wear resistant material. Typically, the prior art roof drill bit is replaced after only one pass.

A further problem with the prior art roof drill bit is the generation of very fine dust particles, which causes the vacuum system to work harder than is necessary. Those particles which escape the vacuum system become a health hazard to those in the mine.

The applicant of the present invention is familiar with another type of rotary drill bit which is illustrated in U.S.S.R. Inventor's Certificate No. 395271. The present applicant is a coinventor of the drill bit disclosed in this document. The rotary drill bit illustrated in this Inventor's Certificate was also the subject of a paper authored by the applicant. This paper was entitled "Hand-Held Power Tools for Drilling Small Diameter Holes in Construction Materials," *Industrial Construction and Engineering Structures Magazine,* Kiev (USSR), Volume 1 (1975).

The rotary drill bits illustrated in the Inventor's Certificate and in the paper are masonry drill bits for drilling in concrete, brick or other similar construction materials with a hand-held electric drill. These masonry drill bits are tipped with wedge-shaped inserts. A comparison of the operating conditions of masonry drill bits and roof drill bits illustrates the fact that the suitability of a drill bit for use as a masonry drill bit will not necessarily indicate that this same drill bit is suitable for use as a roof drill bit. The comparison of masonry and roof drill bit operating conditions is as follows:

| | Masonry Bit | Roof Bit |
|---|---|---|
| Cutting Diameter Inches | .5 or less | 1 or more |
| Thrust, Pounds | 40–50 | 1500–7500 |
| Speed, rpm | 700–1000 | 250 |
| Power at Motor, HP | .25–.35 | 3–5 |
| Torque, Foot-Pounds | 1.3–2.5 | 60–80 |

It is immediately obvious from this comparison that the thrust, power and torque for the respective masonry and roof drill bits differ by orders of magnitude.

Accordingly, it is an object of the invention to have a roof drill bit, and insert therefor, without any of the disadvantages of the prior art roof drill bits.

It is another object of the invention to have a roof drill bit and insert therefor, which achieves the optimum in strength and resistance to chipping and fracturing.

It is another object of the invention to have a roof drill bit, and insert therefor, that can drill faster at lower thrust levels and suffer less wear than the prior art use of drill bits.

It is still another object of the invention to have a roof drill bit, and insert therefor, that is economical to manufacture and cost effective in use.

BRIEF SUMMARY OF THE INVENTION

Disclosed according to the invention is a two-prong rotary bit, especially for use with roof drills. The bit comprises a supporting body having an axis of rotation and a pair of inserts. Each of the inserts has a cutting portion facing in the direction of rotation, a mounting portion and, when viewed in a direction parallel to the axis of rotation, a cross sectional configuration which is generally wedge-shaped.

The advantages of this two-prong bit over the prior art bit, as shown in FIG. 1, are many. One advantage of the two-prong bit is that it is stronger due to the wedge shape of the inserts. Another advantage of the two-prong bit is the way it proceeds through the rock. The two-prong bit proceeds through the rock by first, fracturing and crushing the rock, then penetrating the fractured and crushed rock, and finally shearing the rock.

As a result of this cutting action, there is lower thrust and, consequently, lower wear of the inserts. Due to the lower wear of the inserts, there is also less friction generated during a drilling process so that the drill can be operated at higher drilling speeds.

In contrast, the prior art drill bit as explained earlier crushes the rock, penetrates through the crushed rock and then shears the rock. Because it takes more energy to crush rock than to fracture it, this type of action requires higher thrust and higher wear on each of the inserts which will then generate more friction. As a consequence, the prior art drill bit has to be operated at a lower drilling speed.

Also disclosed as a separate article of commerce is an insert especially for use with a roof drill bit. This insert comprises a generally wedge-shaped body. There are two planar front faces tapering toward each other and intersecting so as to form a face cutting edge. Opposite to the face cutting edge the two planar front faces diverge and terminate in a mounting portion. The insert also comprises a clearance face and a support face angularly related to and separated by the face cutting edge, the clearance face intersecting the front faces so as to form two main cutting edges. The clearance face also intersects the mounting portion. Finally, the face cutting edge and the two main cutting edges coincide in a common apex.

The apex of the wedge-shaped insert is an important feature of the invention since it has been proven to be effective in fracturing the rock, instead of crushing the rock as was the case with the prior art drill bit.

BRIEF DESCRIPTION OF THE DRAWINGS

The exact nature of the present invention will become more clearly apparent upon reference to the following detailed specification taken in connection with the accompanying drawings in which:

FIG. 1 is a perspective view of a prior art drill bit.

FIG. 10 is an enlargement of the plan view of the insert shown in FIG. 9.

DETAILED DESCRIPTION OF THE INVENTION

Figure 2:
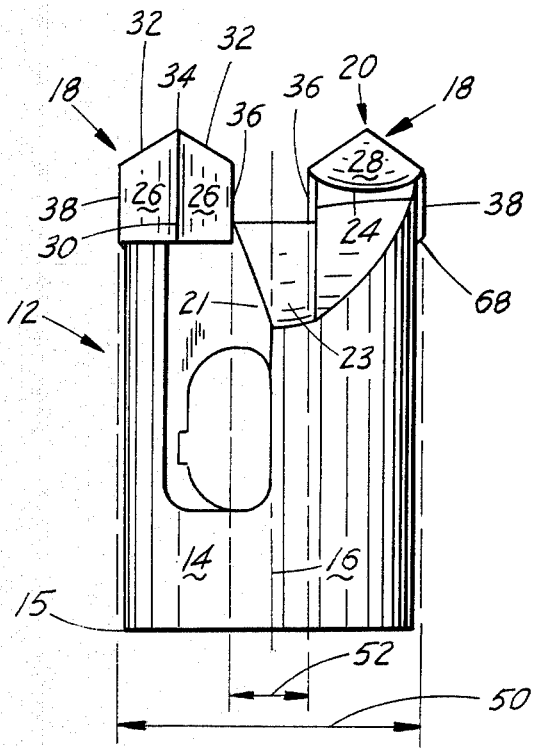
FIG. 2 is a front view of the drill bit according to the invention.

Referring to the drawings in more detail, and specifically referring to FIGS. 2 to 5, disclosed according to the invention is a two-prong bit 12, especially for use with a roof drill (not shown). The bit comprises a supporting body 14 having an axis of rotation 16. There is a pair of inserts 18, each of the inserts 18 having a cutting portion 20 facing in the direction of rotation 22, a mounting portion 24 and, when viewed in a direction parallel to the axis of rotation 16, a cross sectional configuration which is generally wedge shaped.

In operation, one end 15 of the supporting body would be attached to the roof drill. End 15 would typically have an hexagonal cross section, as is partially shown at 17 in FIG. 4 for connection with a similar hexagonal configuration on the roof drill.

Figure 3:
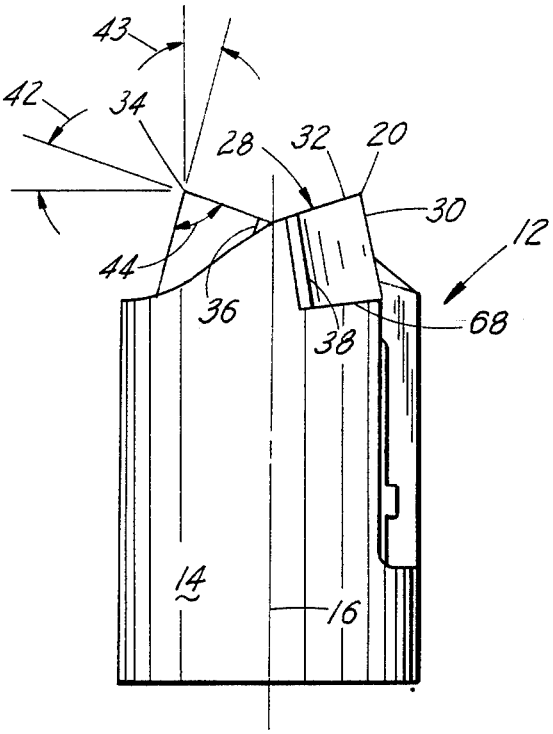
FIG. 3 is the drill bit of FIG. 2 rotated 90 degrees.
Figure 4:
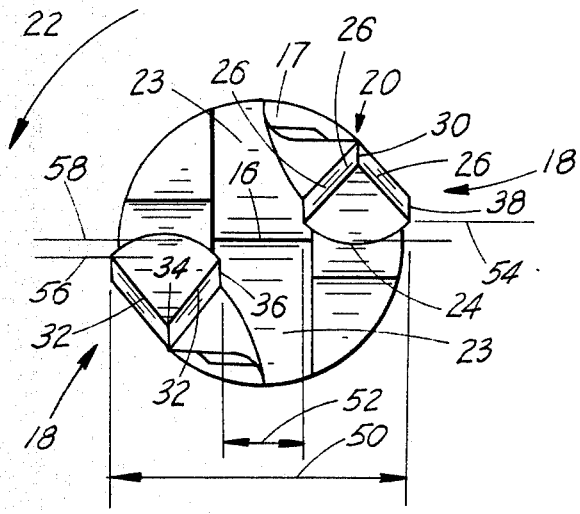
FIG. 4 is a plan view of the drill bit of FIGS. 2 and 3.

The cutting portion 20 of each of the inserts 18 comprises two planar front faces 26 extending forwardly in the rotational sense and axially so as to intersect each other and a clearance face 28. With reference to FIG. 4, the direction of rotation is shown at 22, and it can be seen that the cutting portion of each of the inserts faces and rotates in the direction of rotation. The intersection of the planar front faces forms a face cutting edge 30 at the forwardmost part of the insert. Further, the intersection of each of the planar front faces 26 with the clearance face 28 forms two main cutting edges 32. The face cutting edge 30 and two main cutting edges 32 coincide in a common apex 34. The nature of the apex 34 is most clearly shown in FIGS. 2 and 3. Due to the pointed or nearly pointed nature of the apex, the rock is easily fractured.

The cutting portion 20 of each of the inserts 18 further comprises two lateral cutting edges 36, 38 formed by the intersection of the two planar front faces 26 and the mounting portion 24. One of the lateral cutting edges 36 or 38 is an inner lateral cutting edge 36 and the other lateral cutting edge is an outer lateral cutting edge 38.

Figure 5:
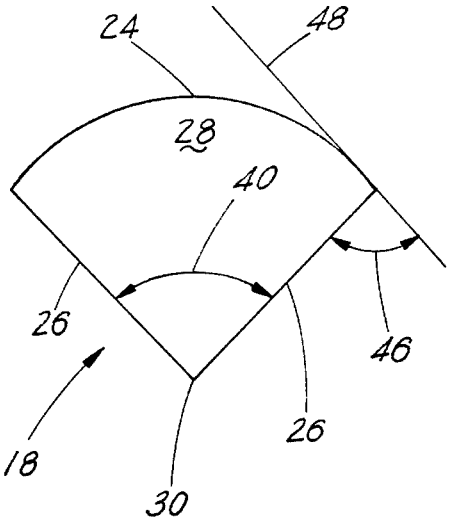
FIG. 5 is an enlarged plan view of the inserts shown with the drill bit of FIGS. 2 to 4.
Figure 6:
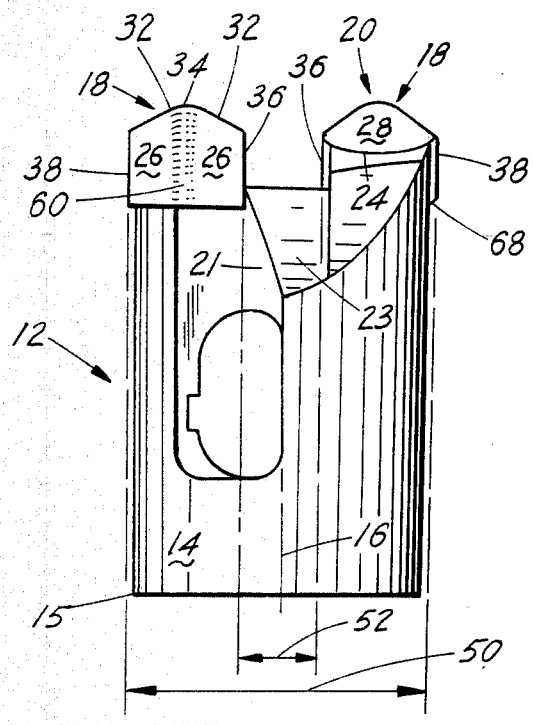
FIG. 6 is a frontal view of another embodiment of a drill bit according to the invention.
Figure 7:
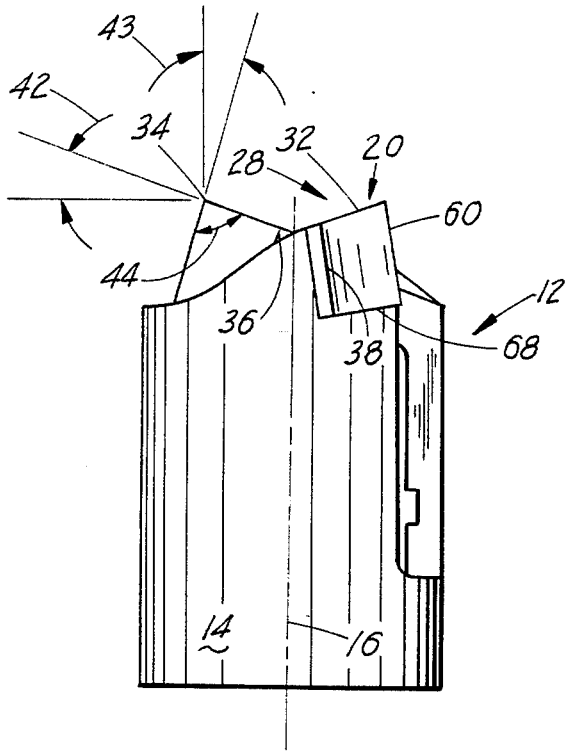
FIG. 7 is the drill bit of FIG. 6 rotated 90 degrees.

As best seen in FIGS. 4 and 5, the mounting portion 24 is curvilinear when viewed parallel to the axis of rotation 16. In a preferred embodiment, the mounting portion is cylindrical as can also be seen in FIG. 2.

Preferably, the dihedral angle 40, as best seen in FIG. 5, between the two planar front faces, is 90 to 100 degrees. As best seen in FIG. 3, it is preferable for each of the inserts that the clearance angle 42 is 15 to 20 degrees, the rake angle 43 is −10 to −20 degrees, and the included angle 44 between the face cutting edge 30 and the clearance face 28 is 70 to 90 degrees.

It has been found that the strength of the insert is enhanced when the dihedral angle is 90 to 100 degrees and the included angle between the face cutting edge and the clearance face is 70 to 90 degrees. The insert will be the strongest when the dihedral angle 40 is 100 degrees and the included angle 44 is 90 degrees.

It has also been found that thrust requirements are minimized when the clearance angle 42 is 15 to 20 degrees and the rake angle 43 is −10 to −20 degrees.

At each of the lateral cutting edges 36, 38, the angle 46, as best seen in FIG. 5, between the planar front face 26 and a plane 48 tangent to the mounting portion 24 is 90 degrees. Constructing the insert so that the mounting portion intersects with the planar front face at an angle of 90 degrees is important for two reasons. The first is that the insert is made stronger and the second reason is that the lateral cutting edge is sharper.

The drill bit 12 has an outside diameter 50, as measured between the respective outer lateral cutting edges, and an inside diameter 52, as measured between the respective inner lateral cutting edges. This is best seen in FIGS. 2 and 4. It is preferred that the outside diameter is about five times greater than the inside diameter. When the ratio of the outside to inside diameter is held at about five, it is insured that the central portion of the hole not cut by the inserts is not so large as to prevent further movement of the drill bit into the hole. At the same time, if the ratio of the outside diameter to the inside diameter is much greater than five, thrust requirements would be increased. Preferably, the ratio of the outside diameter to the inside diameter should be in the range of 4.7 to 5.2.

When the bit is viewed parallel to the axis of rotation 16, a first line 54 passing through the inner and outer lateral cutting edges of one of the inserts will be parallel with a second line 56 passing through the inner and outer lateral cutting edges of the other insert. Preferably, the first 54 and second 56 lines are forward in the rotational sense with respect to a diametric line 58 which is perpendicular to the rotational axis 16 of the bit. By staggering the inserts with respect to the diametric line 58 as is done in the preferred embodiment, it is believed that thrust requirements will be reduced.

In one embodiment of the drill bit, the main 32 and face cutting edges 30 are rectilinear.

The central portion 21 of the supporting body 14 is beefed up so as to strengthen the body. Additionally, the top of the central portion 21 has sloping faces 23 which slope away from the center of the body. Sloping faces 23 assist in the removal of the cut rock.

Figure 8:
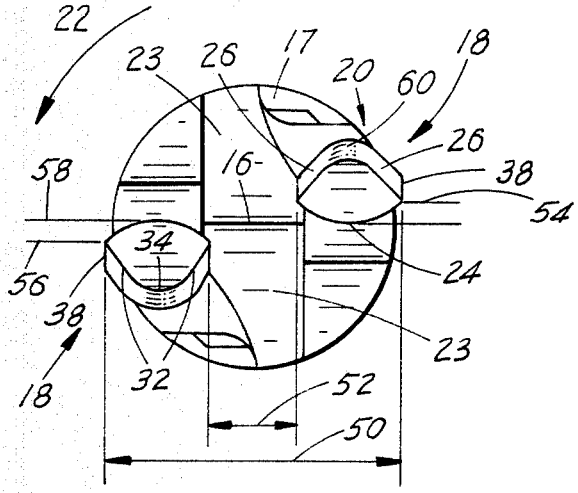
FIG. 8 is a plan view of the drill bit of FIGS. 6 and 7.
Figure 9:
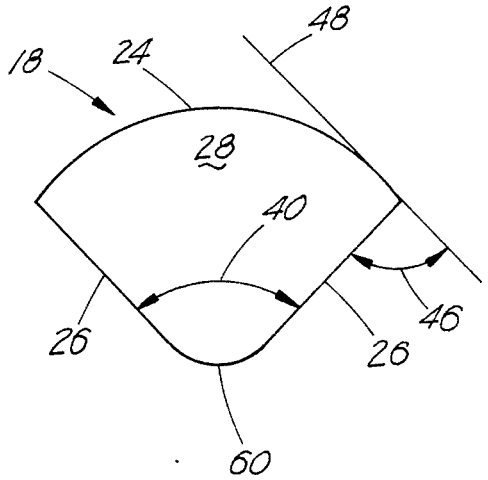
FIG. 9 is an enlarged plan view of the inserts shown with the drill bit of FIGS. 6 to 8.

In another embodiment of the drill bit, as shown in FIGS. 6 through 10, the two main cutting edges 32 are rectilinear and the face cutting edge 60 is cylindrical. The cylindrical nature of the face cutting edge is best seen in FIGS. 8 through 10.

It has been found that the wedge-shaped insert is suitable for drilling in soft rock as well as in very hard rock; however, it has also been found that, when drilling in very hard rock, it is best that the face cutting edge 60 have a cylindrical shape. The cylindrical shape assists in, first, strengthening the insert and, second, preventing the insert from chipping.

In all other respects, the drill bit of FIGS. 6 through 10 is equivalent to the drill bit of FIGS. 2 through 5.

Referring again to the drill bit of FIGS. 6 through 10, and specifically referring to FIG. 10, the radius 62 of the cylindrical mounting portion 24 is R and the radius 64 of the cylindrical cutting edge 60 is 0.5 to 0.707R when the dihedral angle 70 between the two front faces is 90 degrees. When the dihedral angle between the two planar front faces is 100 degrees, then the radius 62 of the cylindrical mounting portion would be R and the radius 66 of the cylindrical cutting edge 70 would be 0.5 to 0.643R.

The radius R of the cylindrical mounting portion is measured from point 61 which is the intersection of the extensions of planar front faces 26. In our experience, the values of R will range from about 0.29 inches for a one inch diameter drill bit to about 0.43 inches for a one and one-half inch diameter drill bit.

Disclosed also as a separate article of commerce is an insert 18 especially for use with a roof drill bit 12.

Referring specifically now to FIGS. 2 through 5, the insert has a generally wedge-shaped body. Two planar front faces 26 taper toward each other and intersect so as to form a face cutting edge 30. Opposite to the face cutting edge, the two planar front faces diverge and terminate in a mounting portion 24. There is also a clearance face 28 and a support face 68 angularly related to and separated by the face cutting edge 30. As seen best in FIG. 3, the clearance face and support face form the top and bottom, respectively, of the insert. While the clearance face and the support face may be parallel, it is not necessary to achieve the objects of the invention that they be parallel and, in fact, as shown in FIG. 3, they are not parallel. The clearance face 28 intersects the front faces 26 so as to form two main cutting edges 32. The clearance face 28 also intersects the mounting portion 24. The face cutting edge 30 and two main cutting edges 32 coincide in a common apex 34.

The insert further comprises two lateral cutting edges 36, 38 formed by the intersection of the two planar front faces 26 and the mounting portion 24.

The mounting portion, as best seen in FIGS. 4 and 5, is curvilinear when viewed from the clearance face. It is preferred that the mounting portion be cylindrical as seen in FIG. 2.

Preferably, the dihedral angle 40 between the two planar front faces 26 is 90 to 100 degrees, and included angle 44 between the face cutting edge 30 and the clearance face 28 is 70 to 90 degrees. For the ultimate in insert strength, it is most preferred that the dihedral angle 40 be 100 degrees and the included angle 44 be 90 degrees.

It is also preferable that at each of the lateral cutting edges 36, 38, the angle 46 between the planar front face 26 and a plane 48 tangent to the mounting portion 24 be 90 degrees.

In the embodiment of the insert as shown in FIGS. 2 to 5, the main 32 and face 30 cutting edges are rectilinear.

Referring now to FIGS. 6 through 10, another embodiment of the insert according to the present invention is shown. In all respects, the insert shown in FIGS. 6 to 10 is similar to the insert seen in FIGS. 2 to 5 except that the face cutting edge 60 is cylindrical instead of rectilinear.

It is preferred that when the dihedral angle 70 between the two planar front faces is 90 degrees and the radius 62 of the cylindrical mounting portion is R, then the radius 64 of the cylindrical cutting edge 60 is 0.5 to 0.707R. When the dihedral angle 72 between the two planar front faces is 100 degrees, then the radius 66 of the cylindrical face cutting edge 60 is 0.5 to 0.643R. This is best shown in FIG. 10.

TEST RESULTS

Applicant has undertaken comparative performance testing between the prior art standard center vacuum bit as shown in FIG. 1, and a wedge-shaped inserted bit according to this invention. In Table 1, the bit geometry is described for each of the standard bit and the wedge-shaped inserted bit.

Each of the drill bits was drilled into a sample of Barre granite, which is a hard type of rock. The tests began by starting approximately at the same initial thrust. The operator of the drilling rig would then attempt to maintain a constant penetration rate for each of the drill bits. When the penetration rate began to decrease, thrust would be increased. Penetration rate and thrust were constantly monitored. After the test hole of about 28 inches in length was completed, the thrust at completion (maximum thrust) was noted. The drill bits were then removed from the drilling rig and examined for wear. Finally, specific wear (width of wear land per feet of hole drilled) for the drill bits was calculated.

Table 2 shows results of the testing.

Even though an attempt was made to maintain a constant penetration rate for both types of bits, the standard bit fell behind the wedge-shaped inserted bit, notwithstanding the increased amount of thrust applied. It should be noted that the maximum thrust of 7497 pounds applied to the standard bit is close to the critical thrust load at which point sufficient heat due to friction will be generated that the hardness of the cemented carbide will begin to decrease. If this critical thrust load is maintained for any length of time, the drill bit will self-destruct.

Most noteworthy of the test results is the comparative wear of the bits. The standard bit exhibited over one hundred percent more specific wear than the wedge-shaped inserted bit.

Several conclusions can be drawn from the results in Table 2. Overall, the wedge-shaped inserted bit performed much better than the standard bit. The wedge-shaped inserted bit can drill faster and at lower thrust levels *and* suffers less wear than the standard bit. Ultimately, by drilling at lower thrust levels, there is less chance that the insert will break, and by drilling with less wear, this means that the bit can be used for longer periods of time and so will be cost effective.

TABLE 1

| | Insert Shape | |
|---|---|---|
| | Standard | Wedged |
| Rake Angle | 0° | −10° |
| Clearance Angle | 20° | 15° |
| Included Angle | 70° | 85° |
| Dihedral Angle | — | 98° |

TABLE 2

| | Insert Shape | |
|---|---|---|
| | Standard | Wedged |
| Initial Thrust, lbs. | 1636 | 1700 |
| Average Thrust, lbs. | 5665 | 4409 |
| Maximum Thrust, lbs. | 7497 | 6116 |
| Penetration Rate, In./Min. | 10.7 | 12.6 |
| Specific Wear, In./Ft. | .079 | .036 |

Modifications may be made within the scope of the appended claims.

What is claimed is:

1. A two-prong bit especially for use with roof drills comprising: a supporting body having an axis of rotation; a pair of inserts, each of said inserts having a cutting portion facing in the direction of rotation, a mounting portion and, when viewed in a direction parallel to the axis of rotation, a cross sectional configuration which is generally wedge-shaped and forms a longitudinally extending face cutting edge at the apex of said wedge.

2. The bit of claim 1 wherein the cutting portion of each of said inserts comprises two planar front faces extending forwardly in the rotational sense and axially so as to intersect each other and a clearance face, the intersection of the planar front faces forming said face cutting edge at the forward most part of the insert and the intersection of each of the planar front faces with the clearance face forming two main cutting edges, the face cutting edge and two main cutting edges coinciding in a common apex.

3. The bit of claim 2 wherein the cutting portion of each of the inserts further comprises two lateral cutting edges formed by the intersection of the two planar front faces and the mounting portion, one of said lateral cutting edges being an inner lateral cutting edge and the other being an outer lateral cutting edge.

4. The bit of claim 3 wherein said mounting portion is curvilinear when viewed parallel to the axis of rotation.

5. The bit of claim 4 wherein the dihedral angle between the two planar front faces is 90 to 100 degrees.

6. The bit of claim 4 wherein the clearance angle for each of said inserts is 15 to 20 degrees.

7. The bit of claim 4 wherein the rake angle for each of said inserts is −10 to −20 degrees.

8. The bit of claim 4 wherein the included angle between the face cutting edge and the clearance face is 70 to 90 degrees.

9. The bit of claim 4 wherein at each of the lateral cutting edges, the angle between the planar front face and a plane tangent to the mounting portion is 90 degrees.

10. The bit of claim 4 having an outside diameter, as measured between the respective outer lateral cutting edges, and an inside diameter, as measured between the respective inner lateral cutting edges, wherein the outside diameter is about five times greater than the inside diameter.

11. The bit of claim 10 wherein the outside diameter is 4.7 to 5.2 times greater than the inside diameter of the bit.

12. The bit of claim 4 wherein said mounting portion is cylindrical.

13. The bit of claim 12 wherein when said bit is viewed parallel to the axis of rotation, a first line passing through the inner and outer lateral cutting edges of one of the inserts will be parallel with a second line passing through the inner and outer lateral cutting edges of the other insert.

14. The bit of claim 13 wherein said first and second lines are forward, in the rotational sense, with respect to a diametric line which is perpendicular to the rotational axis of the bit.

15. The bit of claim 14 wherein the main and face cutting edges are rectilinear.

16. The bit of claim 14 wherein the two main cutting edges are rectilinear and the face cutting edge is cylindrical.

17. The bit of claim 16 wherein the radius of said cylindrical mounting portion is R and the radius of said cylindrical cutting edge is 0.5 to 0.707R when the dihedral angle between the two planar front faces is 90 degrees.

18. The bit of claim 16 wherein the radius of said cylindrical mounting portion is R and the radius of said cylindrical cutting edge is 0.5 to 0.643R when the dihedral angle between the two planar front faces is 100 degrees.

* * * * *